US007370529B2

(12) United States Patent
Lenz

(10) Patent No.: US 7,370,529 B2
(45) Date of Patent: May 13, 2008

(54) METHOD FOR BALANCING AN OBJECT HAVING MULTIPLE RADIAL PROJECTIONS

(76) Inventor: Michael A. Lenz, 1235 Highpoint La., Waukesha, WI (US) 53189

( * ) Notice: Subject to any disclaimer, the term of this patent is extended or adjusted under 35 U.S.C. 154(b) by 465 days.

(21) Appl. No.: 11/205,975

(22) Filed: Aug. 17, 2005

(65) Prior Publication Data

US 2006/0039785 A1 Feb. 23, 2006

Related U.S. Application Data

(60) Provisional application No. 60/602,598, filed on Aug. 19, 2004.

(51) Int. Cl.
*G01M 1/32* (2006.01)

(52) U.S. Cl. ..... 73/455; 73/466; 416/144

(58) Field of Classification Search ..... 73/455, 73/457, 466; 416/144, 145
See application file for complete search history.

(56) References Cited

U.S. PATENT DOCUMENTS 4,277,976 A * 7/1981 Mueller et al. ..... 73/457
4,305,292 A * 12/1981 Felter ..... 73/455
6,358,009 B1 * 3/2002 Link ..... 416/145

* cited by examiner

*Primary Examiner*—John E. Chapman
(74) *Attorney, Agent, or Firm*—James Earl Lowe, Jr.

(57) ABSTRACT

A method of balancing a movable rotating object having multiple radial projections, such as a ceiling fan, the method comprising the steps of: attaching to a non-rotating portion of the object a source that emits a focused light, directing the focused light at a target, and then attaching a weight to a location on one of the rotating projections. Then observing the orbit traced by the light source on the target, changing the location of the weight to another location on one of the radial projections, and then observing the change in the orbit on the target.

17 Claims, 4 Drawing Sheets

METHOD FOR BALANCING AN OBJECT HAVING MULTIPLE RADIAL PROJECTIONS

BACKGROUND OF THE INVENTION

This application claims priority from U.S. Provisional Patent Application 60/602,598 filed 19 Aug. 2004.

BACKGROUND OF THE INVENTION

The present invention relates to an object having multiple radial projections which rotate about the center of the object, such as a ceiling fan, and, more particularly, to methods of balancing the object to reduce unwanted movement or wobble.

Any ceiling fan, which operates in a condition where its center of rotating mass does not correspond to its axis of rotation, will exhibit a degree of orbiting proportional to the amount of rotational imbalance and to the square of rotational speed. This orbit or fan wobble can only be corrected by adding weight that will move the center of mass closer toward the center of rotation. The process to achieve this is commonly referred to as balancing.

Traditionally, the process of balancing a fan is that of trial and error. The process has two parts: (1) finding the blade or blades that require the corrective weight; (2) determining the proper location of the weight on the blade(s) to provide the proper influence necessary to bring the center of rotating mass back to the axis of rotation.

To find the blade requiring the corrective weight, first the fan is operated in its uncorrected state and the amount of fan wobble is observed. Then, as a trial weight is placed on each blade, the fan is operated with each blade weight placement, and the effect of the trial weight is observed. A note is made of which blade or blades seem to have an effect on reducing the fan wobble.

Once the blade or blades that have reduced the amount fan wobble are identified, the trial weight can then be moved along the length of the blade to find the location that minimizes the orbit or wobble of the fan.

Each placement of the trial weight requires a start-up and subsequent shut down of the ceiling fan therefore making the balancing process time consuming. Combined with the subjective observation as to the degree of orbiting or fan wobble, a ceiling fan is unlikely to ever operate in a mode where the fan wobble has been truly minimized.

BRIEF SUMMARY OF THE INVENTION

One object of the invention is to provide an apparatus and method to objectively determine the orbit resulting from any changes made to the fan system.

Another object of the invention is to provide an apparatus and method to efficiently find the fan blade or blades that require the corrective weight.

These objects are accomplished by a new method that removes the subjective judgment of the prior art approach to balancing a fan and replaces it with an objective approach. More particularly, the method of this invention is a method of balancing a movable rotating object having multiple radial projections, such as a ceiling fan, the method comprising the steps of: attaching to a non-rotating portion of the object a source that emits a focused light, directing the focused light at a target, and then attaching a weight to a location on one of the rotating projections. Then observing the orbit traced by the light source on the target, changing the location of the weight to another location on one of the radial projections, and then observing the change in the orbit on the target.

Figure 1:
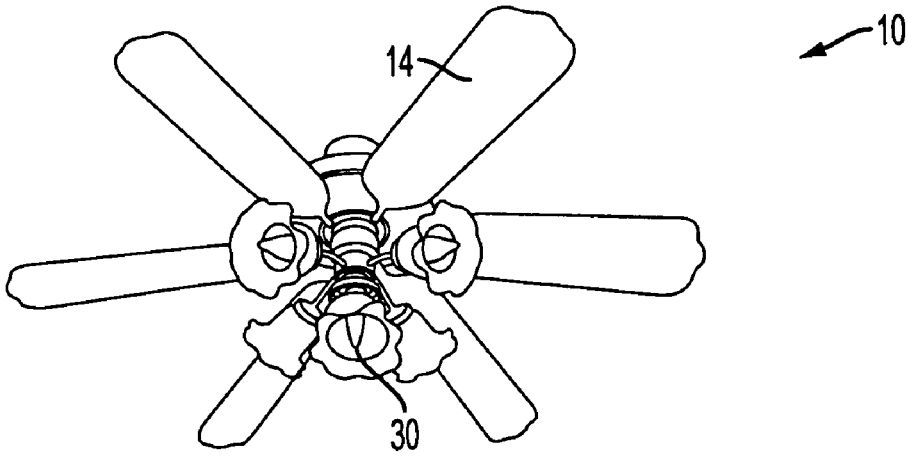
FIG. 1 is a perspective view of a typical ceiling fan including a light fixture.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use of "including" and "comprising" and variations thereof herein is meant to encompass the items listed thereafter and equivalents thereof as well as additional items and equivalents thereof. The use of "consisting of" and variations thereof herein is meant to encompass only the items listed thereafter and the equivalents thereof.

DETAILED DESCRIPTION OF THE PREFERRED EMBODIMENTS

The invention is a method of balancing a movable rotating object 10 having multiple radial projections 14, such as a ceiling fan having multiple fan blades. The rotating object, such as the ceiling fan, is movably mounted to the ceiling by a ball joint connection 18. If the ceiling fan 10 were rigidly fixed to a support, then its movement or wobble could not be observed. Most objects of this type are movably mounted to a support, such as the ceiling, for if not, the object being out of balance would quickly damage the support.

Figure 3:
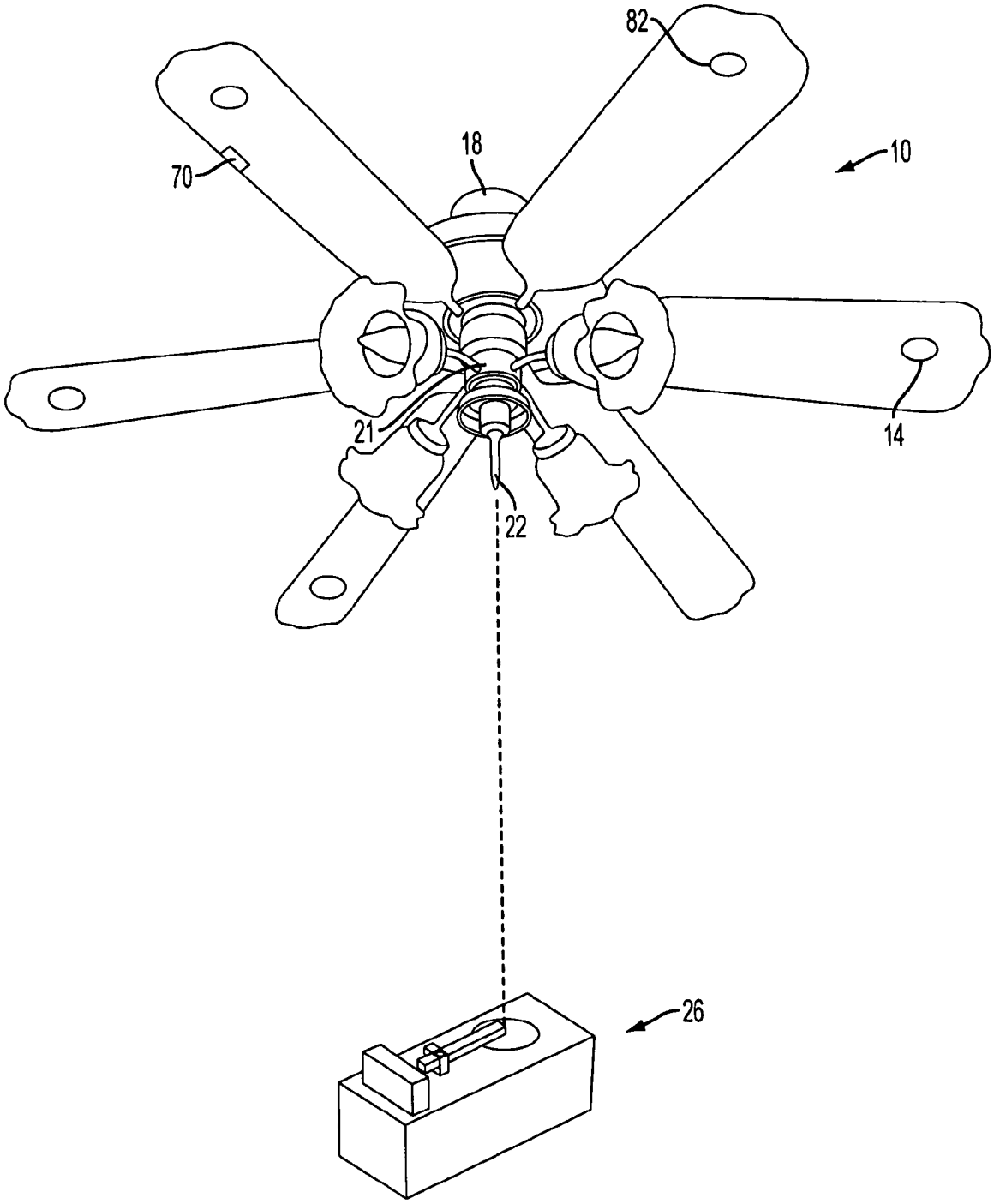
FIG. 3 is a side perspective view of the ceiling fan of FIG. 2 together with a target forming part of this invention.

The method comprises the following steps. First, as shown in FIG. 3, attaching to a non-rotating portion 21 of the fan 10 a source 22 that emits a focused light and directing the focused light at a target 26. In the preferred embodiment, the focused light is a laser beam from a laser diode commonly found in a laser pointer 22, having an on off switch (not shown). The preferred location of the laser pointer 22 is central to the fan 10 and below the fan blades 14. The laser pointer 22 is attached to the fan 10 in such a fashion that there will be no appreciable relative motion between the laser pointer 22 and the non-rotating part of the fan 10 during operation. Additionally, the laser beam should be as close to parallel to the axis of fan rotation as possible.

Figure 2:
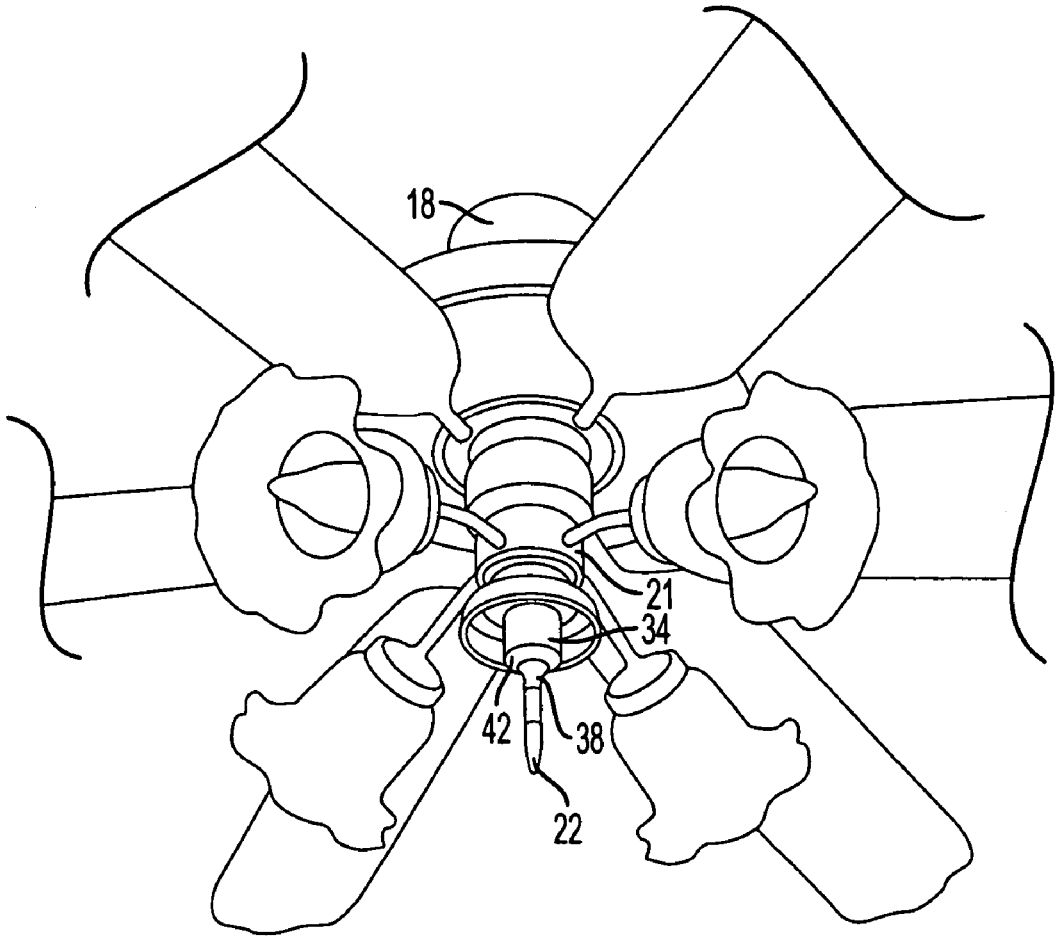
FIG. 2 is a perspective view of the ceiling fan of FIG. 1, only with the central light bulb removed and replaced with a laser-pointing device of this invention.

More particularly, as shown in FIG. 2, the laser pointer 22 is attached to the fan 10 in any suitable fashion, such as by taping or by an adhesive, but preferably is attached to the fan 10, if it has a center light bulb 30 (FIG. 1), as follows. The light bulb 30 is removed, and a light bulb base 34 is inserted into the bulb socket (not visible). A metallic surface, such a metal washer 42, is attached to the light bulb base 34. A magnet 38 is attached to the laser pointer 22, so the laser pointer 22 can then be easily attached magnetically to the washer 42 on the bulb base 34, and the laser pointer light aimed beneath the fan 10.

Figure 4:
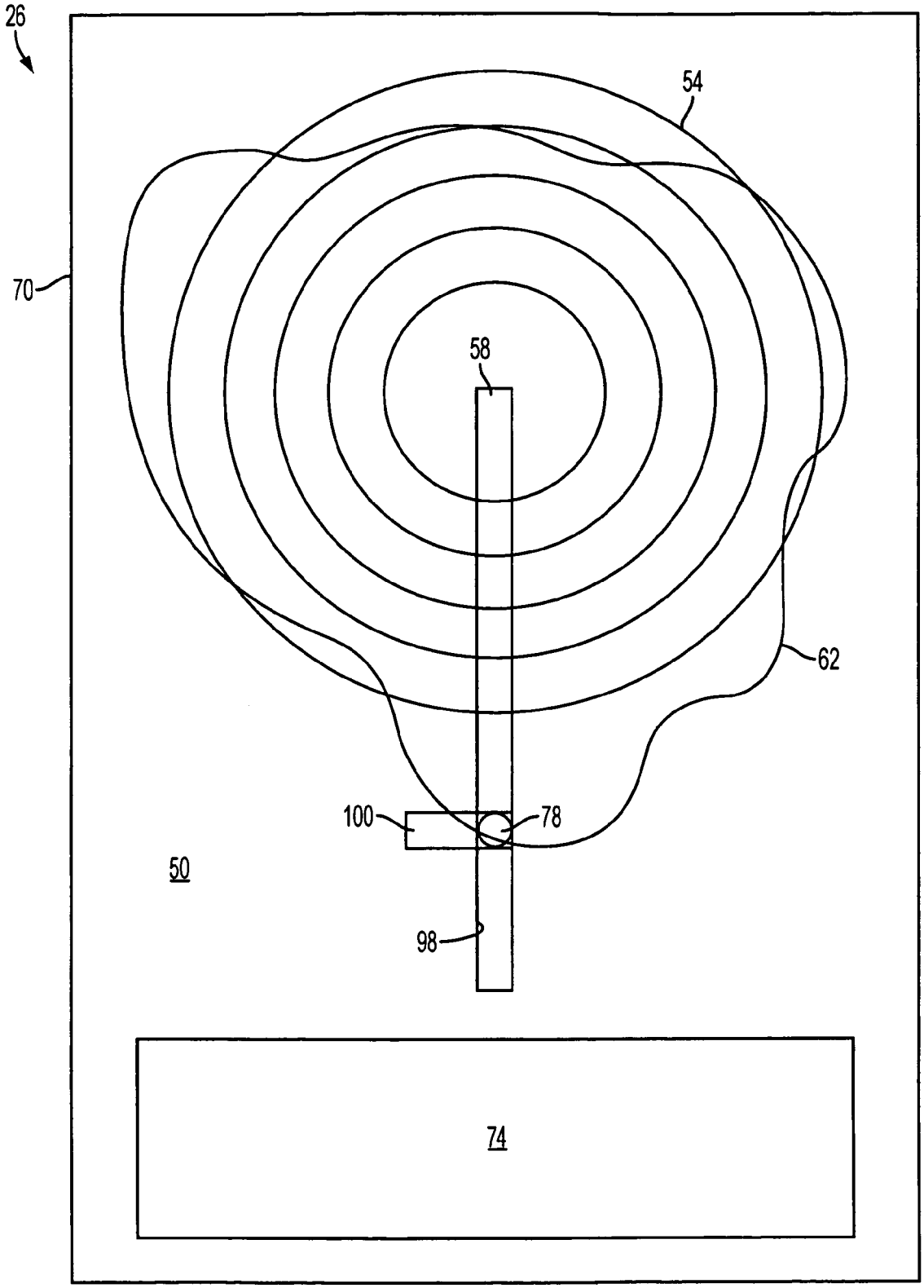
FIG. 4 is a top view of the target of FIG. 3.

The target 26 may be any surface, such a floor in a room, but preferably the target is an object, as shown in FIGS. 3 and 4, with a surface 50 having a series of concentric circles 54. Such a target 26 makes the identifying of changes in the orbit of the laser much easier. With the fan 10 not running, the laser points at the target's center 58. With the fan operating at its highest speed, the laser beam traces an orbit 62, as shown in FIG. 4, proportional to the amount of fan imbalance and distance from the laser source to image surface. The dimensions of the orbit 62 can be easily measured by use of the concentric circles or rings 54. Therefore, a much higher degree of precision of fan balancing can be obtained than by merely observing the movement of the fan without a mechanism to quantify it, as in the traditional method.

The method comprises first observing the orbit traced by the light source 22 on the target 26. This provides a reference orbit for comparison with the orbits traced when a weight is added to a fan blade. The method then comprises attaching a weight 70, as shown in FIG. 3, to a location on one of the rotating fan blades 14, observing the orbit traced by the light source 22 on the target 26, and then changing the location of the weight 70 to another location on one of the radial fan blades. With each location change, the change in the orbit 62 on the target 26 is observed.

Preferably, the weight 70 is placed in the first instance in about the middle of a blade 14. The weight 70 may be attached to the blade 14 in any fashion, but preferably the weight is in the form of a spring clip (not shown) that can be easily slid on the edge of the blade 14. Another preferred embodiment of the weight is a piece of metal 70 with a light adhesive backing for removably attaching the metal to the blade 14.

When changing the location of the weight 70 to another location on one of the fan blades 14, the new location is preferably on a different fan blade 14. With each change to a different blade, the orbit is observed. After trying the weight on each blade, the observer will see that either one or two blades produce the smallest orbits. It is also possible, however, to change the weight location on the same fan blade 14 before moving to another blade 14.

Once the one or two blades needing a weight are determined, the next step is to move the location of the weight on each blade either towards or away from the radial center of the fan 10. If the orbit 62 increases in size, then the location of the weight is moved in the opposite direction from the radial center of the object moved during the first weight movement, otherwise the weight location is moved in the same direction from the radial center of the object. The observer then continues to change the location of the weight in the same direction as in the preceding step until moving the location of the weight produces no further reduction in the size of the orbit. Lastly, the weight amount on the fan blade at the location can be varied until the smallest orbit is produced. If the end of the blade is reached with the orbit still getting smaller, than a larger weight is used and the process of moving the location of the weight is repeated.

Although the above method is a significantly simpler approach and produces a better result than in the prior art, it is preferred to identify which fan blade 14 needs the weight 70 added in the first instance. Accordingly, in the most preferred embodiment of this invention, the target 26 includes a strobe light 74 and an optical sensor 78 that flashes the strobe light 74 when the focused light hits the optical sensor 78 on the target 26. Further, since each fan blade 14 is usual identical to each other, each fan blade 14 is marked with unique indicia 82 to make each fan blade uniquely observable to an observer. The target optical sensor 78 is positioned at the point where the orbit 62 appears furthest from the orbit's center point. When the fan 10 is then operated, the strobe light will flash when the laser pointer crosses the optical sensor 78.

More particularly, as shown in FIGS. 3 and 4, the target includes a box 90 with an upper surface 50 having the concentric circles or rings 54 and the strobe light 74. The optical sensor 78 is slidably mounted on a guide 98 on the box surface, and a slide 100 is attached to the optical sensor 78 is used to position the sensor 78 in the path of the laser light. More particularly, the optical sensor 78 sits in the bottom of a hole in the slide 100. Further, the optical sensor 78 is at least partially reflective. As a result, a portion of the laser beam that contacts the optical sensor 78 is reflected back onto the fan near the fan blades 14. This reflected beam helps the observer determine which blade or blades need the weight or weights.

Figure 5:
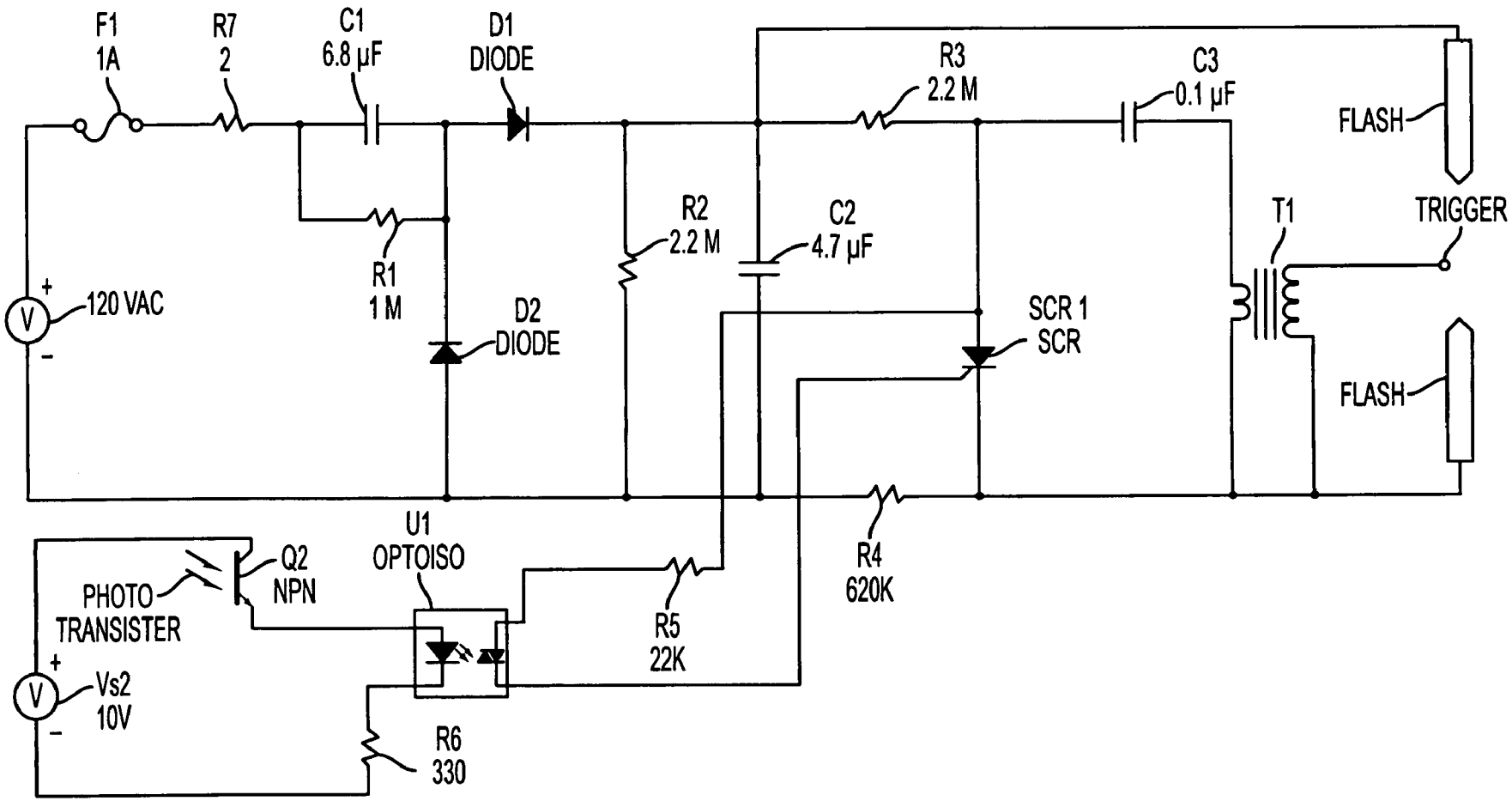
FIG. 5 is an electrical schematic of a strobe light and triggering circuit used in the target of FIGS. 3 and 4.

FIG. 5 is a self explanatory schematic of the target's electrical circuit.

A net centrifugal force acting on rotating body will tend to displace the rotating center. Since the net centrifugal force results from the "heavy spot" in the rotating system, it can be concluded that a relationship exists between the "heavy spot", the force created by it, and the motion resulting from the force. In a system operating well below its natural resonant frequency, the force created by the heavy spot will produce a displacement that is in-phase or at the same location as the "heavy spot" that created it. In a system operating well above its natural resonant frequency, the centrifugal force will produce displacement that is out-of-phase or opposite the location as the "heavy spot" the created it.

Since the fan is likely operating above its pendulum oscillating frequency or natural resonance, the location of the heavy blade will be frozen 180 degrees away from the location of the optical pickup or sensor 78. So the blade or blades 14 requiring the weight will be frozen in phase with the optical pickup. Brightly and different colored stickers 82 placed on each fan blade 14 readily identify them in the strobe light and uniquely identify them when the fan 10 is stopped.

More particularly, when the laser light hits the optical sensor 78, and since the heaviest blade will be on the side of the fan opposite the optical sensor 78, the weights should be added to the blade directly above the optical sensor 78. So by observing which fan blade 14 is above the optical sensor 78 with the benefit of the strobe light 74, the reflected laser beam and the blade's unique indicia 82, the blade requiring the weight can be identified. And if directly above the location of the optical sensor 78 is a space between two fan blades 14, then first placing a first weight on one fan blade on one side of the space and then placing a second equal weight on the other fan blade on the other side of the space, the observer can observe the orbit traced by the light source on the target 26. The weight location or locations are then changed, and then the change in the orbit on the target 26 can be observed. It may end up being that the weight location on one blade may be different than the weight location on its adjacent blade.

Even without the strobe light 74 and optical pickup 78, the balancing process of a ceiling fan 10 is enhanced over traditional methods by the objective measurement of the laser orbit in response to any changes to the fan system, i.e., weight and speed.

Various features of the invention are set forth in the following claims.

The invention claimed is:

1. A method of balancing a movable rotating object having multiple radial projections, the method comprising the steps of:

attaching to a non-rotating portion of the object a source that emits a focused light, directing the focused light at a target, attaching a weight to a location on one of said rotating projections, observing the orbit traced by said light source on said target, changing said location of said weight to another location on one of said radial projections, and then observing the change in said orbit on said target.

2. The method of claim 1 wherein when changing said location of said weight to another location on one of said radial projections, the new location is on the same radial projection.

3. The method of claim 1 wherein the target is a surface having a plurality of concentric circles.

4. The method of claim 1 wherein the source of focused light is a laser.

5. The method of claim 1 and further including the steps of:

then repeating the weight attachment step above on each of the other projections until the location on a particular projection is found that produces the smallest orbit.

6. The method of claim 5 and further including the steps of:

then varying the weight amount on said projection at said location until the smallest orbit is produced.

7. A method of balancing a movable rotating object having multiple radial projections, the method comprising the steps of:

attaching to a non-rotating portion of the object a source that emits a focused light, directing the focused light at a target, attaching a weight to a location on one of said rotating projections, observing the orbit traced by said light source on said target, changing said location of said weight either towards or away from the radial center of said object, if said orbit increases in size, then changing said location of said weight in the opposite direction from the radial center of said object moved during the first weight movement, otherwise changing the weight location in the same direction from the radial center of said object, then continuing to change said location of said weight in the same direction as in the preceding step until moving the location of said weight produces no further reduction in the size of said orbit.

8. The method of claim 7 and further including the steps of:

before changing the weight location on a particular projection, repeating the weight attachment step above on each of the other projections until the location on a particular projection is found that produces the smallest orbit.

9. The method of claim 8 and further including the step of then varying the weight amount on said projection at said location until the smallest orbit is produced.

10. The method of claim 7 wherein the target is a surface having a plurality of concentric circles.

11. The method of claim 7 wherein the source of focused light is a laser.

12. A method of balancing a movable rotating object having multiple radial projections, the method comprising the steps of:

attaching to a non-rotating portion of the object a source that emits a focused light and directing the focused light at a target including a strobe light and an optical sensor that flashes said strobe light when said focused light hits said optical sensor on said target, marking each projection with unique indicia to make each projection uniquely observable to an observer, positioning said target optical sensor at the point where the orbit appears furthest from the orbit's center point, placing the weight on either the projection directly above the location of the optical sensor, by observing which projection is above the optical sensor with the benefit of the strobe light and its unique indicia or, if directly above the location of the optical sensor is a space between two projections, then first placing a first weight on one projection on one side of the space and then placing a second weight on the other projection on the other side of the space, observing the orbit traced by said light source on said target, changing the weight location or locations equally, and then observing the change in said orbit on said target.

13. The method of claim 12 wherein said location of said weight is first changed either towards or away from the radial center of said object, if said orbit increases in size, then changing said location of said weight in the opposite direction from the radial center of said object moved during the first weight movement, otherwise changing the weight location in the same direction from the radial center of said object, then continuing to change said location of said weight in the same direction as in the preceding step until moving the location of said weight produces no further reduction in the size of said orbit.

14. The method of claim 12 and further including the steps of varying the weight amount on said projection at said location until the smallest orbit is produced.

15. The method of claim 12 wherein the target is a surface having a plurality of concentric circles.

16. The method of claim 12 wherein the source of focused light is a laser.

17. The method of claim 12 wherein said optical sensor has a reflective surface.

* * * * *